US007336058B1

(12) United States Patent
Lo et al.

(10) Patent No.: US 7,336,058 B1
(45) Date of Patent: Feb. 26, 2008

(54) MULTISTAGE LOW DROPOUT VOLTAGE REGULATION

(75) Inventors: Ping Lo, Santa Clara, CA (US); Xuecheng Jin, Palo Alto, CA (US)

(73) Assignee: iWatt Inc., Los Gatos, CA (US)

( * ) Notice: Subject to any disclaimer, the term of this patent is extended or adjusted under 35 U.S.C. 154(b) by 0 days.

(21) Appl. No.: 11/671,793

(22) Filed: Feb. 6, 2007

(51) Int. Cl.
*G05F 1/40* (2006.01)

(52) U.S. Cl. ..... 323/269

(58) Field of Classification Search ..... 323/268, 323/269, 274

See application file for complete search history.

(56) References Cited

U.S. PATENT DOCUMENTS 6,031,362 A * 2/2000 Bradley ..... 323/269

* cited by examiner

*Primary Examiner*—Shawn Riley
(74) *Attorney, Agent, or Firm*—Fenwick & West LLP

(57) ABSTRACT

A low dropout (LDO) voltage regulator having more than one LDO modules, each LDO module having a frequency response adapted to a certain range of output frequency. The LDO voltage regulator can provide a gain over a broad range of operating frequency by combining output current from each LDO module and providing the combined current at an output of the LDO voltage regulator. The LDO voltage regulator further comprises a load monitor coupled to the LDO modules for disabling some of the LDO modules to reduce power consumption of the LDO voltage regulator.

15 Claims, 5 Drawing Sheets

MULTISTAGE LOW DROPOUT VOLTAGE REGULATION

BACKGROUND OF THE INVENTION

1. Field of the Invention

The invention relates generally to a low dropout voltage regulator, and more specifically, to a low dropout voltage regulator providing improved voltage regulation over a broad range of operating frequency.

2. Description of the Related Art

Voltage regulators can be classified into two different classes. One class is shunt regulators that place dissipative elements in parallel with a load and control the shunted current to control the output voltage. The other class is series pass regulators which places dissipative control elements between the input voltage and the load. The series pass regulators have become dominant regulators because they are significantly more efficient than the shunt regulators. The LDO voltage regulators are a type of series pass regulator that typically uses common emitter or common source output stages.

The LDO voltage regulators are voltage regulators that produce a regulated output voltage even when the unregulated input voltage from a power source falls to a level very near the regulated output voltage. The difference between the input voltage and the output voltage of the regulator is called the "dropout voltage." In other types of voltage regulators, the dropout voltage often exceeds 2 volts. Therefore, when the power source drops below a voltage level (the regulated output voltage plus the dropout voltage), the power voltage regulators fail to deliver the regulated output voltage. The LDO voltage regulators are characterized by low dropout voltage. Therefore, the LDO voltage can provide a regulated output voltage even when other types of voltage regulators fail because of the drop in the voltage level of the power source.

FIG. 1 shows a schematic diagram of a conventional LDO voltage regulator 28. The LDO voltage regulator 28 receives an unregulated voltage $V_{DD}$ from a voltage input 32 and provides a regulated output voltage $V_O$ across a load $R_L$. To achieve that result, the LDO voltage regulator 28 includes a voltage input 32 coupled to a voltage source $V_{DD}$ and a voltage output 30 coupled to a load $R_L$. The LDO voltage regulator 28 also includes an error amplifier 12, a feedback path 14, a MOSFET M1, and a voltage divider comprised of two resistors $R_1$ and $R_2$.

A feedback voltage is obtained from the voltage divider ($R_1$, $R_2$) and is provided to the negative input of the error amplifier 12 through the feedback path 14. A reference voltage $V_{REF}$ is provided to the positive input of the error amplifier 12. An input current $I_{in}$ of the LDO voltage regulator 28 is provided from a voltage source $V_{DD}$ to the drain of the MOSFET M1. The error amplifier 12 provides an output voltage 16 that represents a difference between the reference voltage $V_{REF}$ and the feedback voltage. The gate of the MOSFET M1 receives the output voltage 16 from the error amplifier 12. The source of the MOSFET M1 is coupled to the output 30 of the LDO voltage regulator 28. The MOSFET M1 provides an output voltage Vo across the load $R_L$ so that a voltage $\{R_1/(R_1+R2)\times Vo\}$ tracks the reference voltage $V_{REF}$.

Conventional LDO voltage regulators do not provide desirable gain characteristics and a fast settling time over a broad range of operating frequency. This is because an LDO voltage regulator can perform only within the limits imposed by the gain-bandwidth product of the error amplifier 12. The gain-bandwidth product determines the maximum gain that can be obtained from the error amplifier 12 for a given frequency. If the error amplifier 12 is operated beyond the limits of the gain-bandwidth product, the output voltage Vo from the LDO voltage regulator 28 will be excessively distorted. Therefore, the conventional LDO voltage regulators 28 do not provide desirable gain characteristics over a wide range of the operating frequency.

Furthermore, conventional LDO voltage regulators do not provide a power saving feature. It is desirable to adjust the performance of a LDO voltage regulator based on the load condition of the output or available power from the power source. Conventional LDO voltage regulators, however, operate with the same level of performance and power consumption regardless of the load condition or power available from a power source.

Therefore, there is a need for a LDO voltage regulator that has desirable gain characteristics and response speed over a broad range of operating frequency. There is also a need for a LDO voltage regulator that has adjustable performance based on the output load condition and power available from a power source.

SUMMARY OF INVENTION

An embodiment of the invention provides a low dropout (LDO) voltage regulator having more than one LDO modules, each LDO module having a frequency response adapted to a certain range of operating frequency. The LDO voltage regulator can regulate an output voltage over a broad range of operating frequency by combining an output current from each LDO module. The combined output current is provided to a load of the LDO voltage regulator to obtain a regulated output at the output of the LDO voltage regulator.

In one embodiment of the invention, each module includes an error amplifier and a transistor. Each error amplifier comprises a first input, a second input and an output. The first input of the error amplifier receives the feedback voltage. The second input of the error amplifier receives a reference voltage. The output of the error amplifier provides an output voltage representing a difference between the reference voltage and the feedback voltage. The first terminal of the transistor is coupled to the output of the LDO voltage regulator to provide an output voltage across a load based on the difference.

In one embodiment of the invention, the LDO voltage regulator includes three LDO modules: a low frequency LDO module, a middle frequency LDO module, and a high frequency LDO module. The low frequency LDO module has a first frequency response that is adapted to a low frequency range. The middle frequency LDO module has a second frequency response that is adapted to a middle frequency range. The high frequency LDO module has a third frequency response that is adapted to a high frequency range.

In one embodiment, the LDO voltage regulator further comprises a load monitor. The load monitor receives the feedback voltage and disables some of the LDO modules based on the feedback voltage. The performance and power consumption of the LDO voltage regulator can be adjusted by selectively enabling certain LDO modules.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the invention can be readily understood by considering the following detailed description in conjunction with the accompanying drawings.

DETAILED DESCRIPTION OF EMBODIMENTS

The Figures (FIG.) and the following description relate to preferred embodiments of the invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the invention(s), examples of which are shown in the accompanying figures. It is noted that wherever practicable similar or like reference numbers may be used in the figures and may indicate similar or like functionality. The figures depict embodiments of the invention for purposes of illustration only. One skilled in the art will readily recognize from the following description that alternative embodiments of the structures and methods shown herein may be employed without departing from the principles of the invention described herein.

Figure 1:
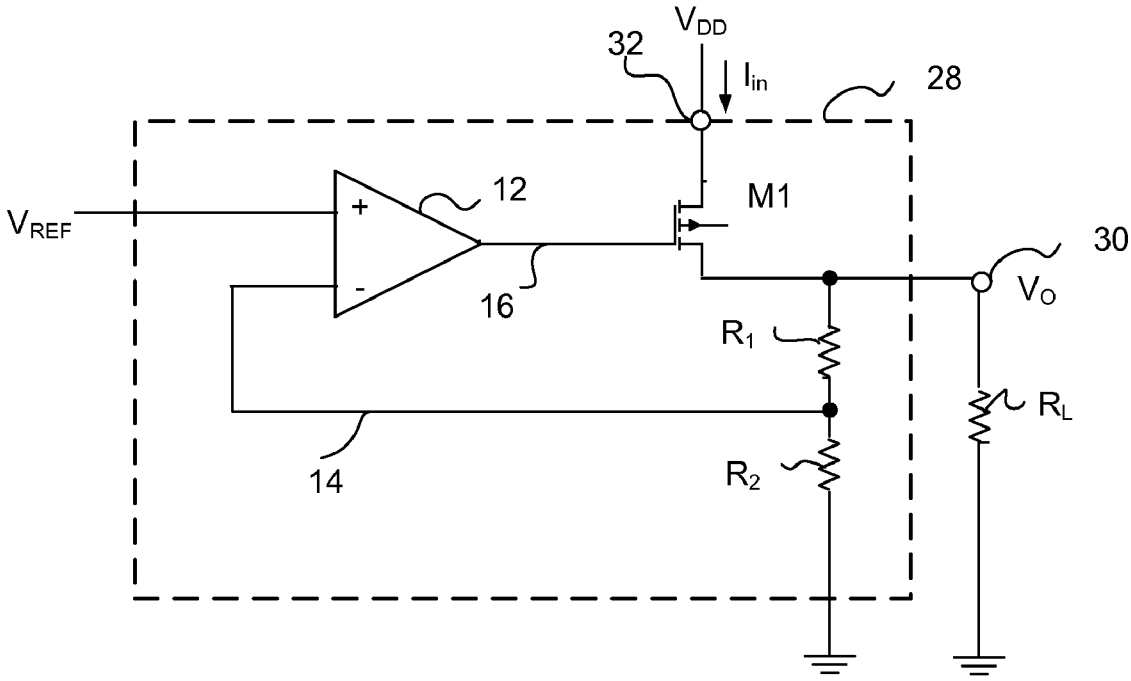
FIG. 1 (Prior Art)
FIG. 1 is a schematic showing a conventional LDO voltage regulator.
Figure 2:
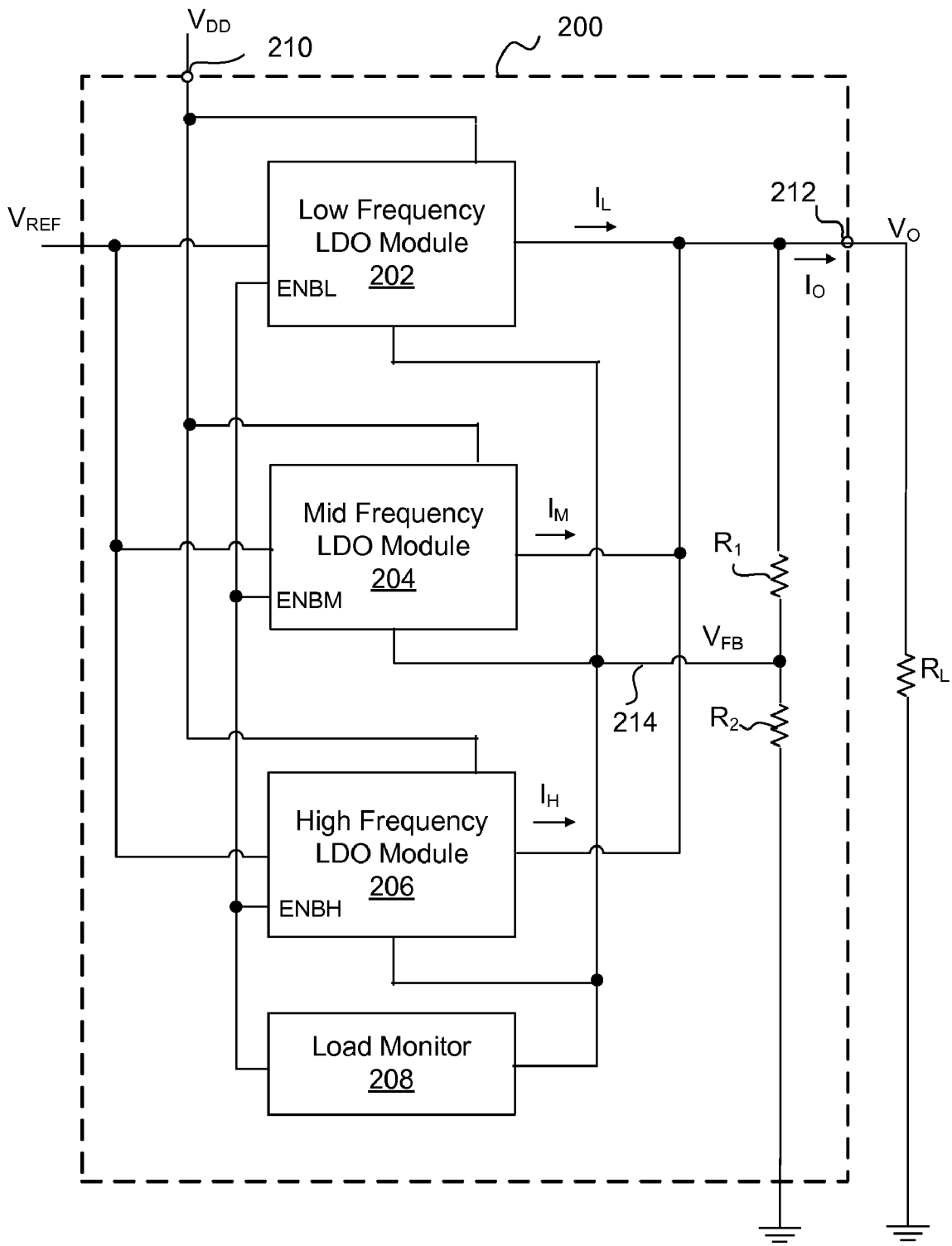
FIG. 2 is a block diagram of a LDO voltage regulator, according to an embodiment of the invention.

FIG. 2 is a block diagram of a low dropout (LDO) voltage regulator 200 according to an embodiment of the invention. The LDO voltage regulator 200 includes a low frequency LDO module 202, a middle frequency LDO module 204, a high frequency LDO module 206, a load monitor 208, and a voltage divider including two resistors $R_1$ and $R_2$. The low frequency LDO module 202, the middle frequency LDO module 204, and the high frequency LDO module 206 are placed in parallel between a voltage input 210 and a voltage output 212 of the LDO voltage regulator 200. The low frequency LDO module 202, the middle frequency LDO module 204, and the high frequency LDO module 206 provide a first current $I_L$, a second current $I_M$, and a third current $I_H$ to the output 212, respectively. The first current $I_L$, the second current $I_M$, and the third current $I_H$ are combined to provide an output current $I_O$ at the output 212. The output 212 of the LDO voltage regulator 200 is coupled to a load $R_L$, providing an output voltage $V_O$ across the load $R_L$. Although three modules 202, 204, 206 are used in this embodiment of FIG. 2, note that only two LDO modules or more than three LDO modules can be used.

Most of the current $I_O$ is obtained from the low frequency LDO module 202. The middle frequency LDO module 204 and the high frequency LDO module 206 complement the low frequency LDO module 202 by providing part of the output current (i.e., $I_M$ and $I_H$), each settling quickly in the middle and high frequency ranges, respectively. The detailed structures of the LDO modules 202, 204, 206 are explained below with reference to FIG. 3. In one embodiment, the first current $I_L$ of the low frequency LDO module 202, the second current $I_M$ of the medium frequency LDO module 204, and the third current $I_H$ of the high frequency LDO module 206 contribute to approximately 80%, 18% and 2% of the output current $I_O$, respectively.

A feedback path 214 provides a feedback voltage $V_{FB}$ to LDO modules 202, 204, 206, and the load monitor 208. The feedback voltage $V_{FB}$ is a voltage signal scaled down from the output voltage $V_O$ by the voltage divider (including the resistors $R_1$ and $R_2$). As will be explained below with reference to FIG. 3, the feedback voltage $V_{FB}$ is compared with a reference voltage $V_{REF}$ to generate the first current $I_L$, the second current $I_M$, and the third current $I_H$ from the low frequency LDO module 202, the middle frequency LDO module 204, and the high frequency LDO module 206, respectively. The output voltage Vo is regulated by the LDO voltage regulator 200 so that the feedback voltage $V_{FB}$ tracks the reference voltage $V_{REF}$.

The load monitor 208 monitors the feedback voltage from the feedback path 214. If the load monitor 208 determines that the variations in the output voltage $V_O$ (caused by changes in the load $R_L$) do not have low, middle or high frequency components covered by the low frequency LDO module 202, the middle frequency LDO module 204 or the high frequency LDO module 206, the load monitor 208 can selectively disable the low frequency LDO module 202, the middle frequency LDO module 204 or the high frequency LDO module 206. Alternatively, the load monitor 208 may selectively disable some of the LDO modules 202, 204, 206 based on external inputs (not shown) that indicates the power mode under which the LDO voltage regulator 200 should operate. For example, when the load monitor 208 receives external inputs indicating that a power save mode is activated, or that the power source is low on power, the load monitor 208 disables the low frequency LDO module 202, the middle frequency LDO module 204 or the high frequency LDO module 206.

Figure 3:
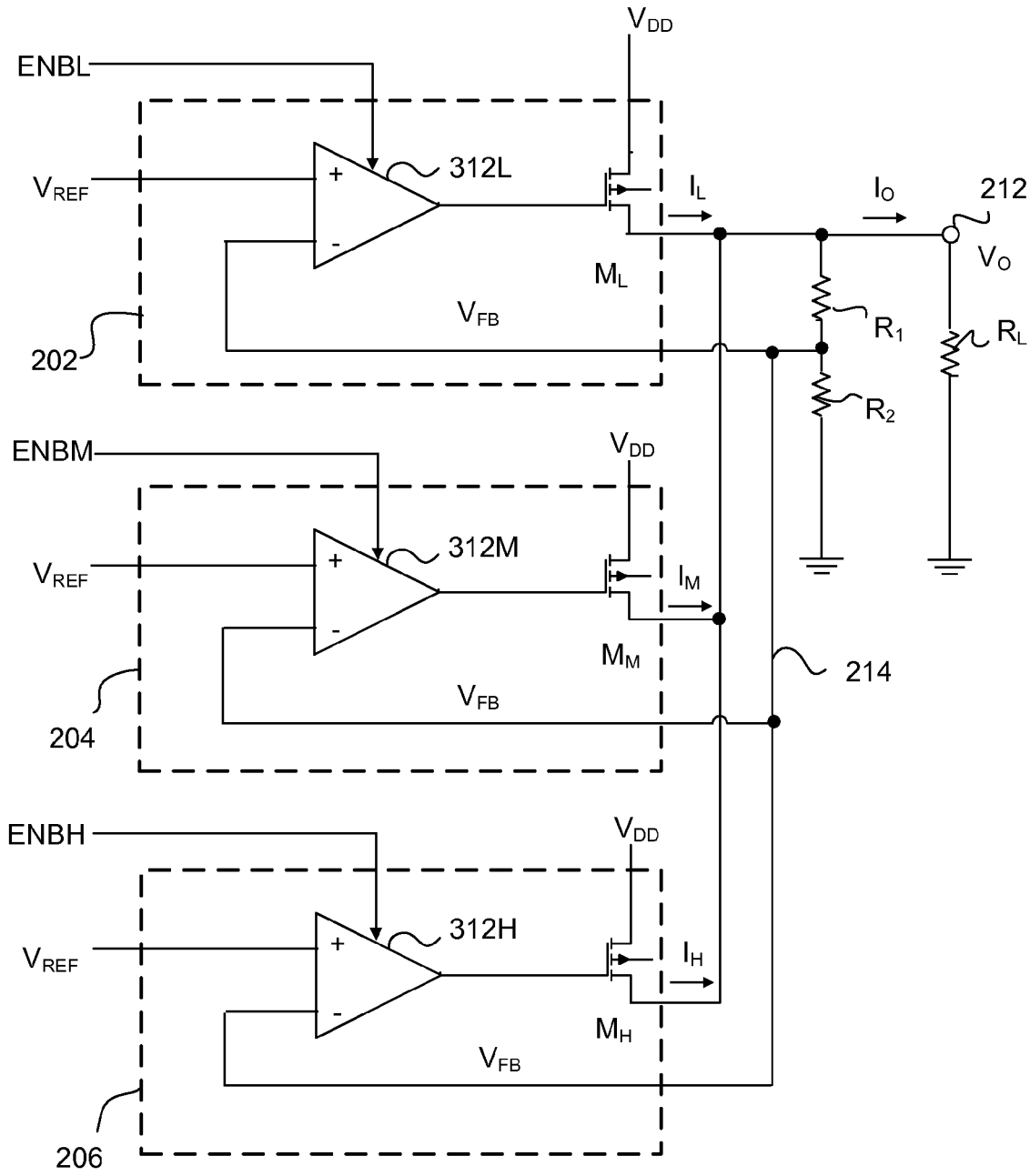
FIG. 3 is a schematic showing the LDO modules of FIG. 2 in more detail, according to an embodiment of the invention.

FIG. 3 is a schematic illustrating the low frequency LDO module 202, the middle frequency LDO module 204, and the high frequency LDO module 206 in detail. Each LDO module 202, 204, 206 includes an error amplifier 312L, 312M, 312H (each of the error amplifiers 312L, 312M, 312H is generally referred to as the error amplifier 312) and a P-channel MOSFET $M_L$, $M_M$, $M_H$ (each of the MOSFETs $M_L$, $M_M$, $M_H$ is generally referred to as the MOSFET M). The P-channel MOSFETs M serve as common-source amplifiers. Each error amplifier 312 has a first input for receiving the reference voltage $V_{REF}$, a second input for receiving the feedback voltage $V_{FB}$ (through the feedback path 214), and an output coupled to the gate of the MOSFET M. It is to be noted that the P-channel MOSFETs can be substituted with N-channel MOSFETs. In this case, the MOSFETs serve as source followers. Also, note that the MOSFETs can be replaced with BJTs (Bipolar Junction Transistors) with corollary changes to the circuits that are well known in the art.

Each of the error amplifiers 312 provides an output to each of the MOSFETs M. The output from the error amplifier 312 is a voltage indicating the difference between the feedback voltage $V_{FB}$ and the reference voltage $V_{REF}$. The output from the error amplifier 312 (at the gate of the MOSFET M) controls output current ($I_L$, $I_M$ and $I_H$) from the MOSFETs M. The output currents ($I_L$, $I_M$ and $I_H$) from the MOSFETs M are combined to provide the output current $I_O$ at the output 212 of the LDO voltage regulator 200.

Each error amplifier 312 also has an enable input ENBL, ENBM, ENBH for receiving enable signals from the load monitor 208. When the enable signals are not asserted at the enable inputs ENBL, ENBM, ENBH, the corresponding error amplifiers 312 are deactivated. The deactivation of the modules 202, 204, 206 conserve power consumption of the LDO voltage regulator 200.

Figure 4:
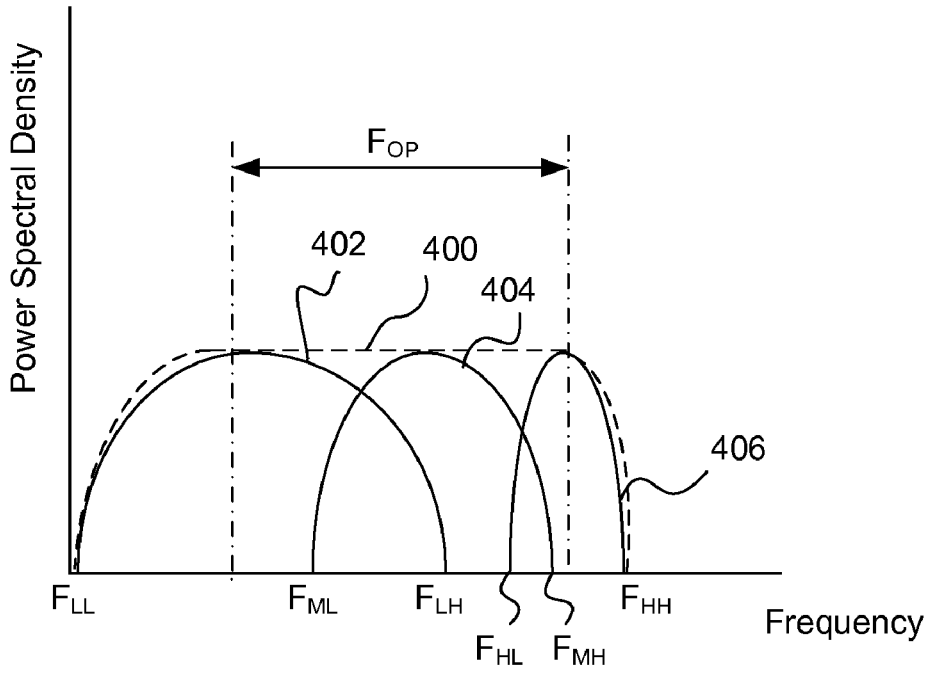
FIG. 4 is a graph showing the power spectral density of a LDO voltage regulator, according to an embodiment of the invention.

FIG. 4 is a graph showing the power spectral density of a LDO voltage regulator, according to an embodiment of the invention. Each error amplifier 312 is adapted to a certain range of operating frequency. In one embodiment, the error amplifier 312L of the low frequency LDO module 202 is a high gain amplifier that has a frequency response adapted to a lower frequency range defined by a lower end $F_{LL}$ and a higher end $F_{LH}$. The error amplifier 312M of the low frequency LDO module 204 is a medium gain amplifier that has a frequency response adapted to a middle frequency range defined by a lower end $F_{ML}$ and a higher end $F_{MH}$. The error amplifier 312H of the high frequency LDO module 206 is a low gain amplifier that has a frequency response adapted to a high frequency range defined by a lower end $F_{HL}$ and a higher end $F_{HH}$.

The operating frequency ranges of the error amplifiers 312 overlap as shown in FIG. 4. Specifically, the operating frequency (i.e., $F_{LL}$ to $F_{LH}$) of the error amplifier 312L overlaps with the operating frequency (i.e., $F_{ML}$ to $F_{MH}$) of the error amplifier 312M. Also, the operating frequency (i.e., $F_{ML}$ to $F_{MH}$) of the error amplifier 312M overlaps with the operating frequency (i.e., $F_{HL}$ to $F_{HH}$) of the error amplifier 312H.

The error amplifiers 312L, 312M, 312H and the MOSFETs $M_L$, $M_M$, $M_H$ are configured so that the power spectral density 400 of the output 212 from the LDO voltage regulator 200 is substantially uniform over an operating frequency range $F_{OP}$ of the LDO voltage regulator 200. The first current $I_L$ from the low frequency module 202 has a power spectral density 402 over a frequency range from $F_{LL}$ to $F_{LH}$. The second current $I_M$ from the middle frequency module 204 has a power spectral density 404 over a frequency range from $F_{ML}$ to $F_{MH}$. The third current $I_H$ of the high frequency module 206 has a power spectral density 406 over a frequency range from $F_{HL}$ to $F_{HH}$. When $I_L$, $I_M$, and $I_H$ are combined into the output current $I_O$, the combined output current $I_O$ has the net power spectral density 400 as shown in FIG. 4.

Figure 5:
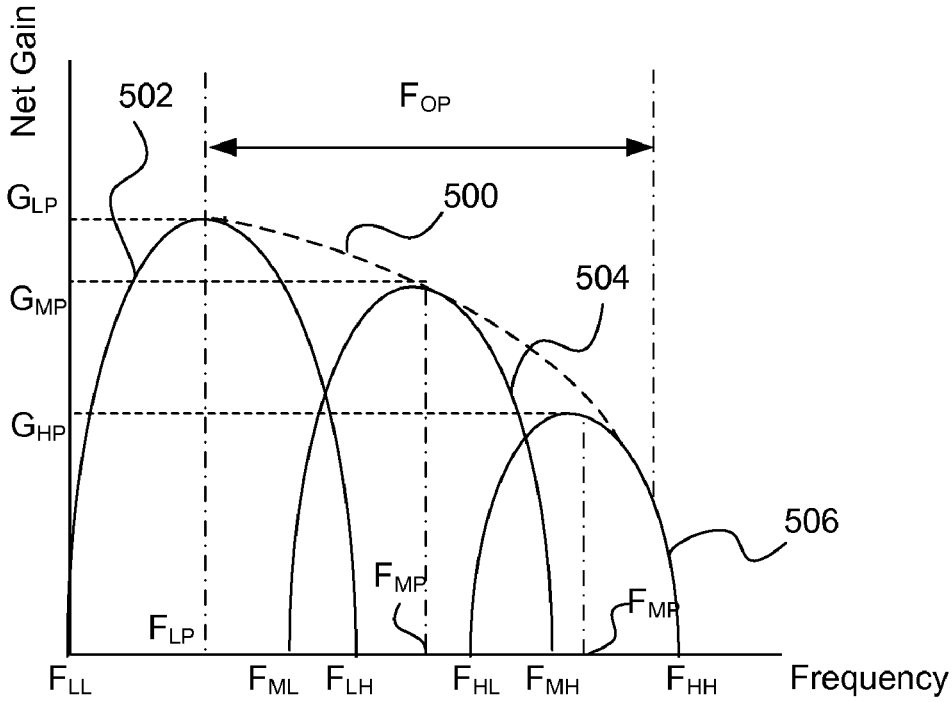
FIG. 5 is a graph showing the gain of a LDO voltage regulator relative to the output frequency, according to an embodiment of the invention.

FIG. 5 is a graph showing the gain of the LDO voltage regulator 200 relative to the output frequency. The error amplifiers 312L, 312M, 312H and the MOSFETs $M_L$, $M_M$, $M_H$ are configured so that the net gain 500 of the LDO voltage regulator 200 decreases gradually as the frequency increases. The net gain 500 of the LDO voltage generator 200 is the sum of: the gain 502 of the low frequency LDO module 202, the gain 504 of the middle frequency LDO module 204, and the gain 506 of the high frequency LDO module 206. To achieve the gradual decrease of the net gain 500, the peak gain $G_{MP}$ of the error amplifier 312M is higher than the peak gain $G_{HP}$ of the error amplifier 312H but lower than the peak gain $G_{LP}$ of the error amplifier 312L. The peak gain of the error amplifier 312 is defined herein as the highest gain achieved from the error amplifier 312 within the operating frequency range $F_{OP}$ of the LDO voltage regulator 200.

As can be seen from FIGS. 4 and 5, the operating frequency $F_{OP}$ of the LDO voltage regulator 200 is broader than that of any single frequency LDO module 202, 204, or 206. Accordingly, the LDO voltage regulator 200 provides a broader operating frequency range compared to a conventional LDO voltage regulator.

Figure 6:
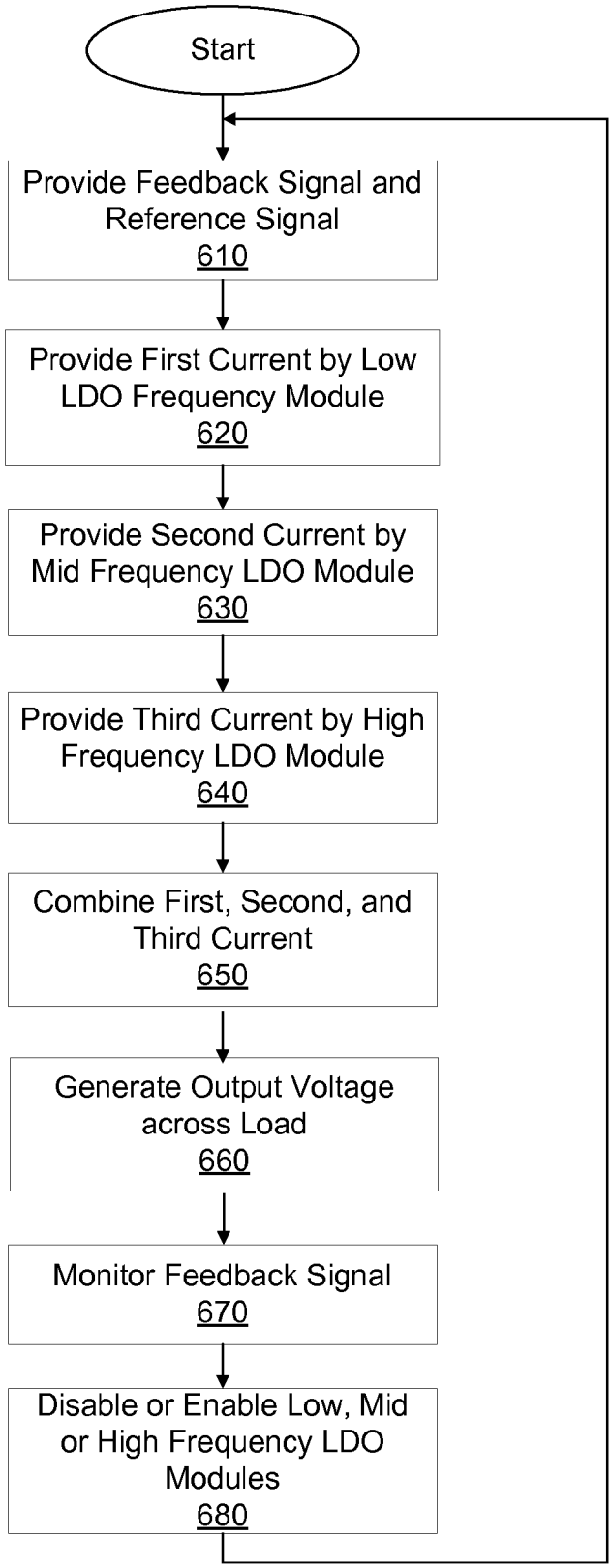
FIG. 6 is a flow chart showing a method of operating a LDO voltage regulator, according to an embodiment of the invention.

FIG. 6 is a flow chart illustrating a method of operating a LDO voltage regulator according to an embodiment of the invention. First, the feedback voltage $V_{FB}$ and the reference voltage $V_{REF}$ are provided 610 to the error amplifiers 312. The first current $I_L$ is provided 620 by the low frequency LDO module 202 based on the reference voltage $V_{REF}$ and the feedback voltage $V_{FB}$. The second current $I_M$ is provided 630 by the middle frequency LDO 204 based on the reference voltage $V_{REF}$ and the feedback voltage $V_{FB}$. The third current $I_H$ is provided 640 by the high frequency LDO module 206 based on the reference voltage $V_{REF}$ and the feedback voltage $V_{FB}$. Then, the first current $I_L$, the second current $I_M$, and the third current $I_H$ are combined 650. The combined current generates 660 the output voltage $V_o$ across the load $R_L$. The feedback voltage $V_{FB}$ is monitored 670 by the load monitor 208. Based on the feedback voltage $V_{FB}$ and the external signals, the load monitor 208 selectively enables or disables 680 the LDO modules 202, 204, 206. Note that the steps 620, 630, and 640 are performed in parallel.

Although the invention has been described above with respect to several embodiments, various modifications can be made within the scope of the invention. Accordingly, the disclosure of the invention is intended to be illustrative, but not limiting, of the scope of the invention, which is set forth in the following claims.

What is claimed is:

1. A low dropout (LDO) voltage regulator providing a regulated output voltage across a load from an unregulated voltage source, the LDO voltage regulator comprising:

a feedback path for providing a feedback voltage representing an output voltage at an output of the LDO voltage regulator;

a first LDO module coupled to the feedback path, an output of the LDO voltage regulator and a reference voltage, the first LDO module generating a first current based on the feedback voltage and the reference voltage, the first LDO module having a first frequency response adapted to a first frequency range; and a second LDO module coupled to the feedback path, the output of the LDO voltage regulator and the reference voltage, the second LDO module generating a second current based on the feedback voltage and the reference voltage, the second LDO module having a second frequency response adapted to a second frequency range, a lower end of the second frequency range higher than a lower end of the first frequency range, the first current and the second current combined and provided to the load to generate the output voltage at the output of the LDO voltage regulator.

2. The LDO voltage regulator of claim 1, further comprising:

a third LDO module coupled to the feedback path, the output of the LDO voltage regulator and the reference voltage, the third LDO module generating a third current based on the feedback voltage and the reference voltage, the first current, the second current and the third current combined and provided to the load to generate the output voltage at the output of the LDO voltage regulator, the third LDO module having a third frequency response adapted to a third frequency range, a lower end of the third frequency range higher than the lower end of the second frequency ranges, the second frequency range partially overlapping with the first and third frequency ranges.

3. The LDO voltage regulator of claim 1, wherein the first module comprises:

a first error amplifier including a first input coupled to the reference voltage, a second input coupled to the feedback voltage and an output, the first error amplifier generating an output voltage representing a difference between the reference voltage and the feedback voltage at the output, the first error amplifier having a first gain in the first frequency range; and a first transistor including a first terminal coupled to the output of the LDO voltage regulator, a second terminal coupled to the output of the first error amplifier, and a third terminal coupled to the voltage source, the output voltage of the first error amplifier controlling the first current from the voltage source to the output of the LDO voltage regulator.

4. The LDO voltage regulator of claim 3, wherein the second LDO module comprises:

a second error amplifier including a first input coupled to the reference voltage, a second input coupled to the feedback voltage and an output, the second error amplifier generating an output voltage representing a difference between the reference voltage and the feedback voltage at the output, the second error amplifier having a second gain in the second frequency range; and a second transistor including a first terminal coupled to the output of the LDO voltage regulator, a second terminal coupled to the output of the second error amplifier, and a third terminal coupled to the voltage source, the output voltage of the second error amplifier controlling a second current from the voltage source to the output of the LDO voltage regulator.

5. The LDO voltage regulator of claim 1, further comprising a load monitor coupled to the feedback path, the load monitor providing signals to the first and the second LDO modules for selectively disabling the first LDO module or the second LDO module based on frequency components of the feedback voltage.

6. A method of operating a LDO voltage regulator, the method comprising:

providing a feedback voltage representing an output voltage of the LDO voltage regulator to a first LDO module and a second LDO module;

providing a first current from the first LDO module based on the feedback voltage and a reference voltage, the first LDO module having a first frequency response adapted to a first frequency range;

providing a second current from the second LDO module based on the feedback voltage and the reference voltage, the second LDO module having a second frequency response adapted to a second frequency range, a lower end of the second frequency range higher than a lower end of the first frequency range;

combining the first current and the second current to provide an output current; and generating the output voltage at an output of the LDO voltage regulator by providing the output current to a load.

7. The method of claim 6, further comprising:

providing the feedback voltage to a third LDO module; and providing a third current from the third LDO module based on the feedback voltage, a lower end of the third frequency range higher than a lower end of the second frequency range, the second frequency range partially overlapping with the first and third frequency ranges; and combining the third current with the first current and the second current to provide the output current.

8. The method of claim 6, wherein providing the first current comprises:

providing the feedback voltage and the reference voltage to a first error amplifier;

generating an output voltage of the first error amplifier representing a difference between the reference voltage and the feedback voltage, the first error amplifier having a first gain in the first frequency range; and providing the first current at a first terminal of a first transistor based on the output voltage of the first error amplifier received at a second terminal of the first transistor.

9. The method of claim 8, wherein providing the second current comprises:

providing the feedback voltage and the reference voltage to a second error amplifier;

generating an output voltage of the second error amplifier representing a difference between the reference voltage and the feedback voltage, the second error amplifier having a second gain in the second frequency range, a lower end of the second frequency range higher than a lower end of the first frequency range; and providing the second current at a first terminal of a second transistor based on the output voltage of the second error amplifier received at a second terminal of the second transistor.

10. The method of claim 6, further comprising:

providing the feedback voltage to a load monitor for monitoring the feedback voltage; and disabling the first or the second LDO module by the load monitor based on the feedback voltage.

11. An integrated circuit comprising an LDO (low dropout) voltage regulator providing a regulated output voltage across a load from an unregulated voltage source, the LDO voltage regulator comprising:

a feedback path for providing a feedback voltage representing an output voltage at an output of the LDO voltage regulator;

a first LDO module coupled to the feedback path, an output of the LDO voltage regulator and a reference voltage, the first LDO module generating a first current based on the feedback voltage and the reference voltage, the first LDO module having a first frequency response adapted to a first frequency range; and a second LDO module coupled to the feedback path, the output of the LDO voltage regulator and the reference voltage, the second LDO module generating a second current based on the feedback voltage and the reference voltage, the second LDO module having a second frequency response adapted to a second frequency range, a lower end of the second frequency range higher than a lower end of the first frequency range, the first current and the second current combined and provided to the load to generate the output voltage at the output of the LDO voltage regulator.

12. The integrated circuit of claim 11, further comprising:

a third LDO module coupled to the feedback path, the output of the LDO voltage regulator and the reference voltage, the third LDO module generating a third current based on the feedback voltage and the reference voltage, the first current, the second current and the third current combined and provided to the load to generate the output voltage at the output of the LDO voltage regulator, the third LDO module having a third frequency response adapted to a third frequency range, a lower end of the third frequency range higher than the lower end of the second frequency ranges, the second frequency range partially overlapping with the first and third frequency ranges.

13. The integrated circuit of claim 11, wherein the first module comprises:

a first error amplifier including a first input coupled to the reference voltage, a second input coupled to the feedback voltage and an output, the first error amplifier generating an output voltage representing a difference between the reference voltage and the feedback voltage at the output, the first error amplifier having a first gain in the first frequency range; and a first transistor including a first terminal coupled to the output of the LDO voltage regulator, a second terminal coupled to the output of the first error amplifier, and a third terminal coupled to the voltage source, the output voltage of the first error amplifier controlling the first current from the voltage source to the output of the LDO voltage regulator.

14. The integrated circuit of claim 11, wherein the second LDO module comprises:

a second error amplifier including a first input coupled to the reference voltage, a second input coupled to the feedback voltage and an output, the second error amplifier generating an output voltage representing a difference between the reference voltage and the feedback voltage at the output, the second error amplifier having a second gain in the second frequency range; and a second transistor including a first terminal coupled to the output of the LDO voltage regulator, a second terminal coupled to the output of the second error amplifier, and a third terminal coupled to the voltage source, the output of the second error amplifier controlling a second current from the voltage source to the output of the LDO voltage regulator.

15. The LDO voltage regulator of claim 11, further comprising a load monitor coupled to the feedback path, the load monitor providing signals to the first and the second LDO modules for selectively disabling the first LDO module or the second LDO module based on frequency components of the feedback voltage.

* * * * *